US005140758A

United States Patent [19]

Damien

[11] Patent Number: 5,140,758

[45] Date of Patent: Aug. 25, 1992

[54] ALPINE SKI/WALKING BOOT

[75] Inventor: Nicolas D. Damien, 13741 Feather Sound Circle East Apt. 810, Clearwater, Fla. 34622

[73] Assignee: Nicolas D. Damien, Clearwater, Fla.

[21] Appl. No.: 714,238

[22] Filed: Jun. 12, 1991

[51] Int. Cl.[5] ..... A43B 5/04

[52] U.S. Cl. ..... 36/117; 36/132

[58] Field of Search ..... 36/117, 120, 132

[56] References Cited

U.S. PATENT DOCUMENTS

| | | | |
|---|---|---|---|
| 4,155,179 | 5/1979 | Weninger | 36/132 |
| 4,194,309 | 3/1980 | Kastinger | 36/132 |
| 4,499,674 | 2/1985 | Olivieri | 36/132 |
| 4,570,363 | 2/1986 | Annovi | 36/117 |
| 4,839,972 | 6/1989 | Pack et al. | 36/117 |
| 4,880,251 | 11/1989 | Wulf et al. | 36/117 |

FOREIGN PATENT DOCUMENTS

| | | | |
|---|---|---|---|
| 2376636 | 9/1978 | France | 36/117 |
| 963447 | 9/1982 | Switzerland | 36/117 |

*Primary Examiner*—Paul T. Sewell
*Assistant Examiner*—M. D. Patterson

[57] ABSTRACT

An alpine ski boot having a curved sole and a rotating boot sole toe. The boot sole toe is rotated upward by hand to allow walking, which is facilitated by the shape of the sole: it is gradually curved from the midsole to the toe. With the boot sole toe rotated down, the boot will engage normally with universally accepted ski bindings and is suitable for any level of skiing. Unlike a conventional boot, the boot sole toe is not in contact with the ground while walking; thus no wear occurs which may hamper binding release.

1 Claim, 7 Drawing Sheets

ALPINE SKI/WALKING BOOT

BACKGROUND OF THE INVENTION

Modern Alpine ski boots are constructed from stiff thermoplastics, and while they facilitate skiing, they are difficult to walk in. The primary reason for this is that the boot sole is flat and inflexible. Those skilled in the art recognize that the problem is solved by attaching a curved oversole or some functionally equivalent device, such as that described by DeFever (U.S. Pat. No. 4,156,316). The ski boot itself can be altered in design to facilitate walking. Annovi (U.S. Pat. No. 4,570,363) and Brugger-Stuker (U.S. Pat. No. 3,971,144) describe boots that have built-in features that increase ease of walking without hindering skiing. The former is a boot with a second sole, and a flexible ankle that can be locked when skiing; the latter is a boot with a curved oversole that is attached at the heel, and can be rotated in and out of position for walking or skiing. This built-in approach may be the the most practical solution to the problem. An attachment such as DeFever's poses an inconvenience to the recreational skier: where to store it while skiing, how to put it on without falling, etc.. The present invention has a unique approach to simplify the composition of a boot that is comfortable to walk in and fully functional to ski in, while requiring no separate attachments or oversoles.

A BRIEF DESCRIPTION OF THE DRAWINGS

DETAILED DESCRIPTION OF THE DRAWINGS AND PREFERRED EMBODIMENTS

In this discussion, the following terms defined in ASTM specification F944-85 are used:

Boot Sole Toe
Boot Sole Heel
Boot Sole Bottom
Midsole Mark

Figure 1:
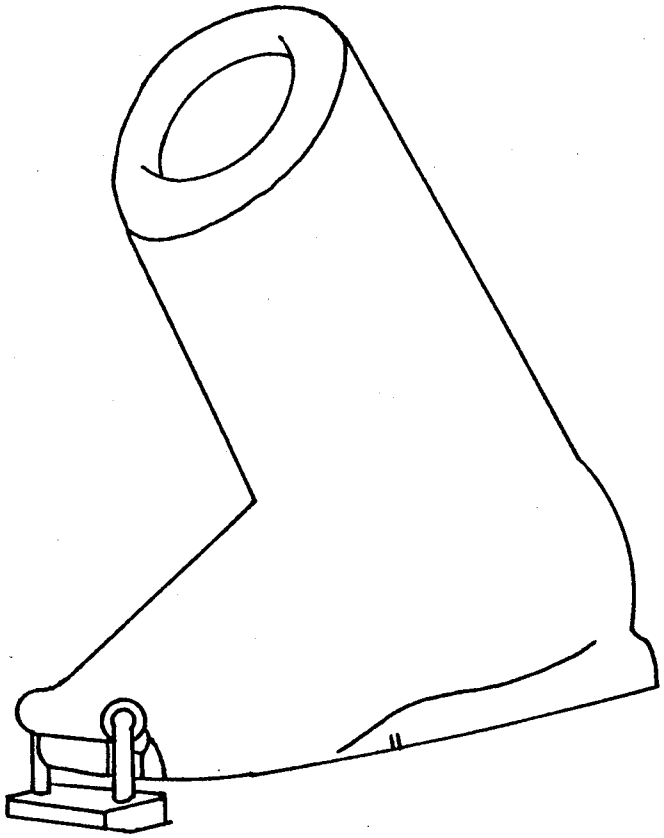
FIG. 1 is perspective view of the boot according to the present invention, in the proper configuration for engaging a ski-binding and for skiing.
Figure 2:
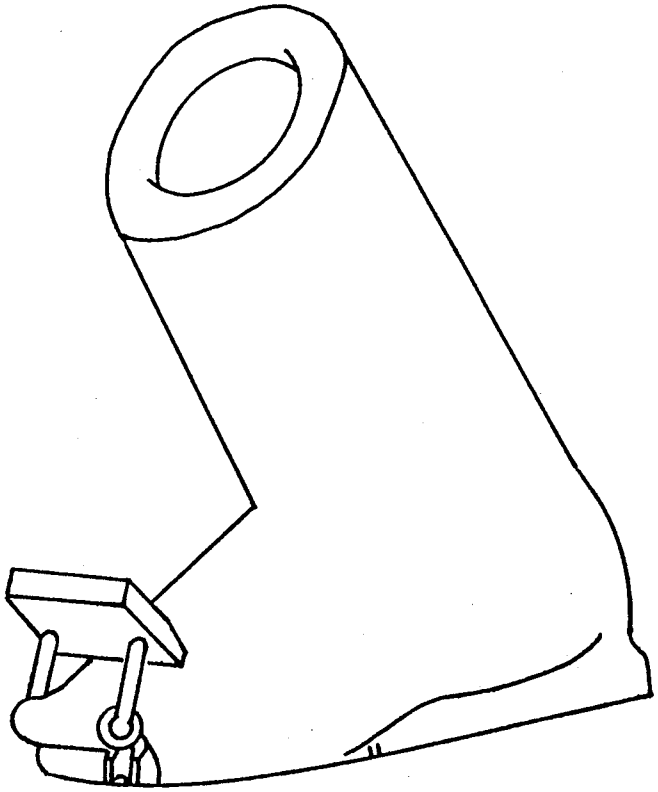
FIG. 2 is a perspective view of the boot, in the proper configuration for comfortable walking.
Figure 3:
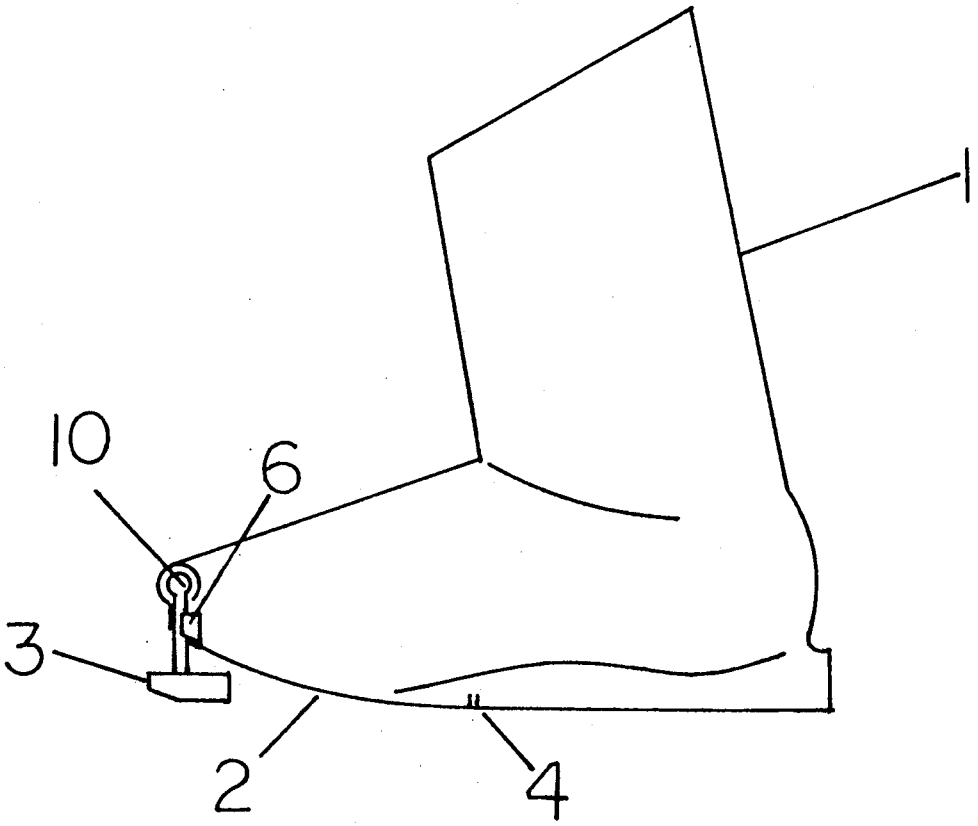
FIG. 3 is an elevation side view of the boot.

Referring to the drawings in detail, where the salient features of the embodiments are identified by and shall be referred to by numerals, FIG. 1 shows a ski boot of conventional construction but with a non-fixed boot sole toe 3. The boot sole toe is rotated upward when the boot is used for walking, as shown in FIG. 2. The curved sole 2 originating at the midsole 4 will allow a rolling type action during walking to compensate for the inflexible construction of the boot. The boot sole toe 3 can be held in the upward position by many different means; a simple method is by adding friction to the rotating joint by means of a slightly compressed plastic washer 8.

With the boot sole toe 3 rotated down as shown in FIG. 1, the ski boot 1 may now engage a standard alpine ski binding. The boot sole toe 3 is secured to support arms 7 which rest solidly against stops 6 when the ensemble 3 and 7 are rotated down. The ensemble 3 and 7 cannot rotate when the boot 1 is engaged by the bindings. Side-to-side motion is prevented by the stops 6; the stop 6 is preferrably contoured to accept and hold snugly the support arm 7. The stop 6 can be a separate piece but is preferrably a molded-in feature of the boot. When the ski is turned on its edge, the support arm 7 on the inside acts as a cantilevered beam, bearing down on the inside of the boot and stop 6. Vertical forces are transmitted up the support arm 7 to the joint at the boss 5.

Figure 4:
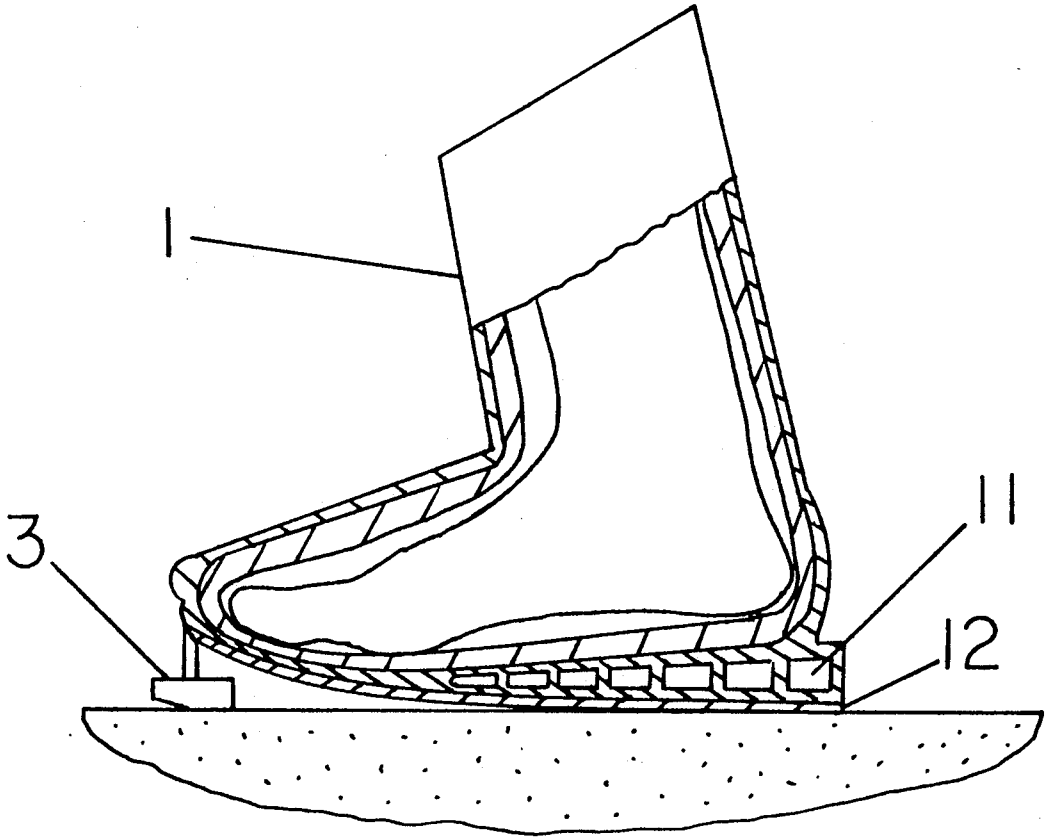
FIG. 4 is a cutaway of the boot that reveals some construction details of the preferred embodiment.

FIG. 4 reveals that the present invention positions the foot and lower leg in the same manner as does a conventional ski boot. In order to do this and still allow for the curvature 2 of the sole, the boot sole from the midsole back to the end of the boot sole heel must be slightly thicker than that of a conventional boot. Thick sections, however, are undesirable for injection molding of plastic parts; the required thickness and strength may be attained with a minimum of material in the construction by using cavities or pockets 11. For shock absorbtion and traction, the boot 1 may have a rubber boot sole bottom 12 with treads or knobs.

Figure 5A:
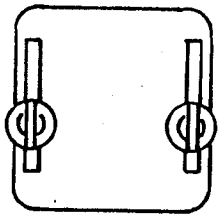
FIG. 5 shows three orthogonal views of a preferred embodiment of the boot sole toe.
Figure 5B:
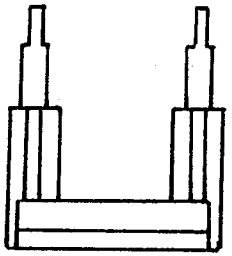
Figure 5C:
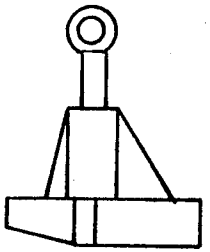

The previous figures show a simplified, almost schematic representation of the ensemble 3 and 7. This was done to illustrate the concept; the physical realization of this requires a more complex construction. In the preferred embodiment shown in FIG. 5, the support arm 7 is a steel shaft molded solidly into the plastic body 3. the underside of the boot sole toe 3 can be made very smooth, reducing friction at the boot-binding interface. In order to decrease friction, 3 may be made of a less durable material than the rest of the boot 1, if such a material demonstrates a low coefficient of friction when in contact with the binding skid plate. Since the boot sole toe 3 is never in contact with the ground or rough surfaces, it is not subject to wear and tear as is a conventional boot. Wear on the boot sole toe can increase friction between the boot and the binding skid-plate, possibly preventing the bindings from releasing. One skilled in the art will recognize that where the support arm 7 joins the body 3, gussets or reinforcing material 13 should be added for strength.

Figure 6:
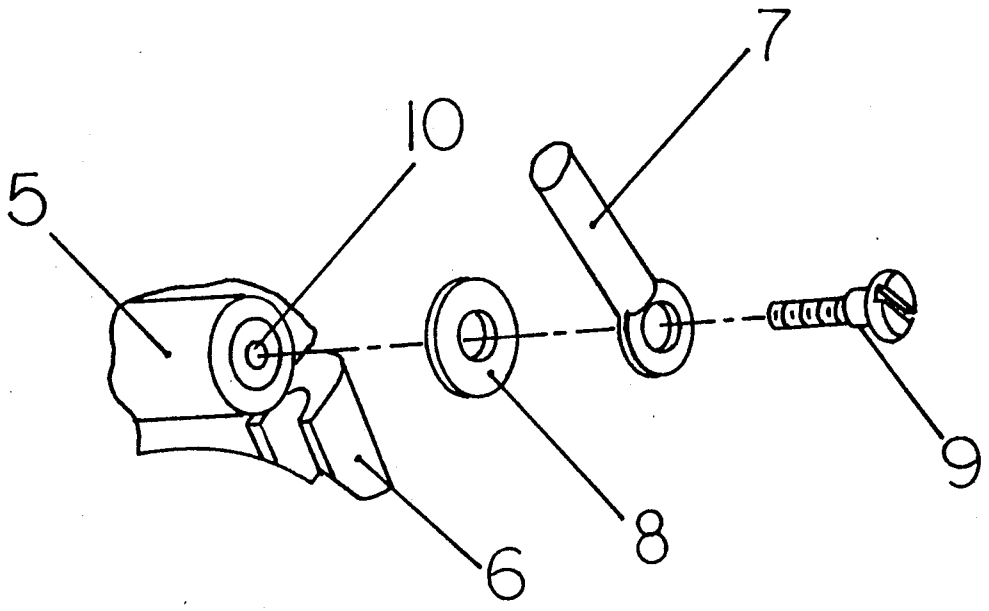
FIG. 6 is an exploded perspective view detailing how the boot sole toe is attached to the boot in a preferred embodiment.

There are many ways to affix the ensemble 3 and 7 to the boot 1 in a manner such that rotation is possible; FIG. 6 shows one simple method. The boot 1 has two cylindrical bosses 5 that are part of the boot's toe construction. They are molded into the boot, and are preferrably blended into the boot to reduce stress concentrations. A threaded insert 10 is captive in the boss 5 and receives a shoulder screw 9 which passes through the eyelet of the support arm 7. A washer 8 made of soft material is slightly compressed between 7 and 5, inducing friction forces that will keep 3 and 7 rotated upward in place while walking.

Figure 7B:
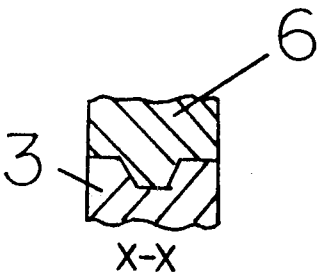
FIG. 7 shows another preferred embodiment of the boot sole toe and the restraining stop.
Figure 7A:
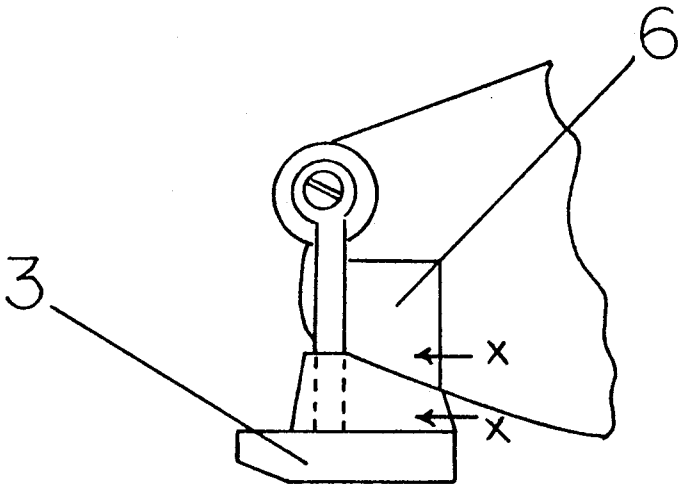

FIG. 7 shows a variation of the stop 6 and the boot sole toe 3. 6 and 3 form opposing wedges which relieve the shoulder screw 9 from loads transmitted through 3. Lateral forces are resisted by the tongue-in-groove construction shown. In such a case, steel support arms 7 may not be necessary; the ensemble 3 and 7 may be be of one-piece molded plastic construction- many variations are possible. These examples discussed are meant to be illustrative of the many functional variations within the scope of the present invention.

In light of the above, it can be appreciated by one skilled in the art that many varying and different embodiments may exist within the scope of my inventive concept as disclosed herein. It is to be understood that the described details of my inventive concept are to be interpreted as illustrative and not in a literal sense. Therefore, what concepts form the scope of my invention are set forth in the appended claims.

I claim:

1. A ski boot with a non-fixed boot sole toe and a curved boot sole comprising:

a.) said boot sole being flat in the region from the boot sole heel to the midsole and curved upwardly from the midsole to the boot sole toe portion such that the curved boot sole facilitates walking;

b.) said non-fixed boot sole toe comprising a plastic body shaped for engaging a ski binding, support arms attached thereto, means for pivotally connecting the ends of the support arms to the front of the ski boot such that said non-fixed boot sole toe can be rotated towards or away from said boot sole, and an angled wedge support surface on the upper portion of said plastic body which rests against a stop having a complimentary angled wedge support surface on the lower front region of the boot sole when said non-fixed boot sole is in position for skiing.

* * * * *